United States Patent [19]

Douglas

[11] Patent Number: 4,748,289

[45] Date of Patent: May 31, 1988

[54] METHOD AND APPARATUS FOR CATALYTIC PROCESSING OF LIGHT HYDROCARBONS AND CATALYSTS FOR USE THEREIN

[75] Inventor: Allan S. Douglas, Sea Cliff, N.Y.

[73] Assignees: Hydratron Systems, Inc., Farmingdale, N.Y.; StarMark Energy Systems, Inc., Memphis, Tenn.

[21] Appl. No.: 3,538

[22] Filed: Jan. 15, 1987

Related U.S. Application Data

[63] Continuation of Ser. No. 797,908, Nov. 14, 1985, abandoned.

[51] Int. Cl.[4] ..... C10L 1/16; C10L 1/04

[52] U.S. Cl. ..... 585/14; 208/15; 208/16; 208/17; 208/243; 208/310 R; 44/56

[58] Field of Search ..... 208/15–17, 208/243, 310 R, DIG. 2; 585/14, 13; 44/2, 56

[56] References Cited

U.S. PATENT DOCUMENTS

| | | | |
|---|---|---|---|
| 1,416,291 | 5/1922 | Hayes | 44/2 |
| 1,938,086 | 12/1933 | Pier | 208/177 |
| 2,549,518 | 4/1951 | Perry | 208/310 R |
| 2,916,446 | 12/1959 | Shuman, Jr. | 208/310 R |
| 2,968,609 | 1/1961 | Lutz | 208/17 |
| 3,000,810 | 9/1961 | Christensen | 208/17 |
| 3,328,289 | 6/1967 | Streed | 208/89 |
| 4,000,988 | 1/1977 | Uemoto et al. | 252/373 |
| 4,299,594 | 11/1981 | Pelrine et al. | 585/14 |
| 4,318,623 | 3/1982 | Curtis | 366/159 |
| 4,382,023 | 5/1983 | Mulaskey | 208/120 |
| 4,579,838 | 4/1986 | Bearden et al. | 208/112 |

*Primary Examiner*—Helen M. S. Sneed
*Assistant Examiner*—Anthony McFarlane
*Attorney, Agent, or Firm*—Schwartz, Jeffery, Schwaab, Mack, Blumenthal & Evans

[57] ABSTRACT

A process and apparatus for converting light hydrocarbons, such as waste organic solvents, to a useful fuel having a high flash point. A mixture of light hydrocarbon and heavy oil, wherein the ratio of light hydrocarbon to heavy oil preferably lies in the range from about 10:1 to about 1:4, is forced at a pressure of preferably at least about 500 psi through a porous substrate having a catalytically effective amount of an active oxide of hexavalent group 6b metal, such as chromium, thereon. The porous substrate may comprise a sintered powder stainless steel material having an average pore size in the range from about 20 to about 2000 microns. The catalyst is prepared by wetting the porous substrate with a solution of a salt of the group 6b metal and heating the wetted substrate until a catalytically active oxide of hexavalent group 6*b* metal is formed thereon.

9 Claims, 1 Drawing Sheet

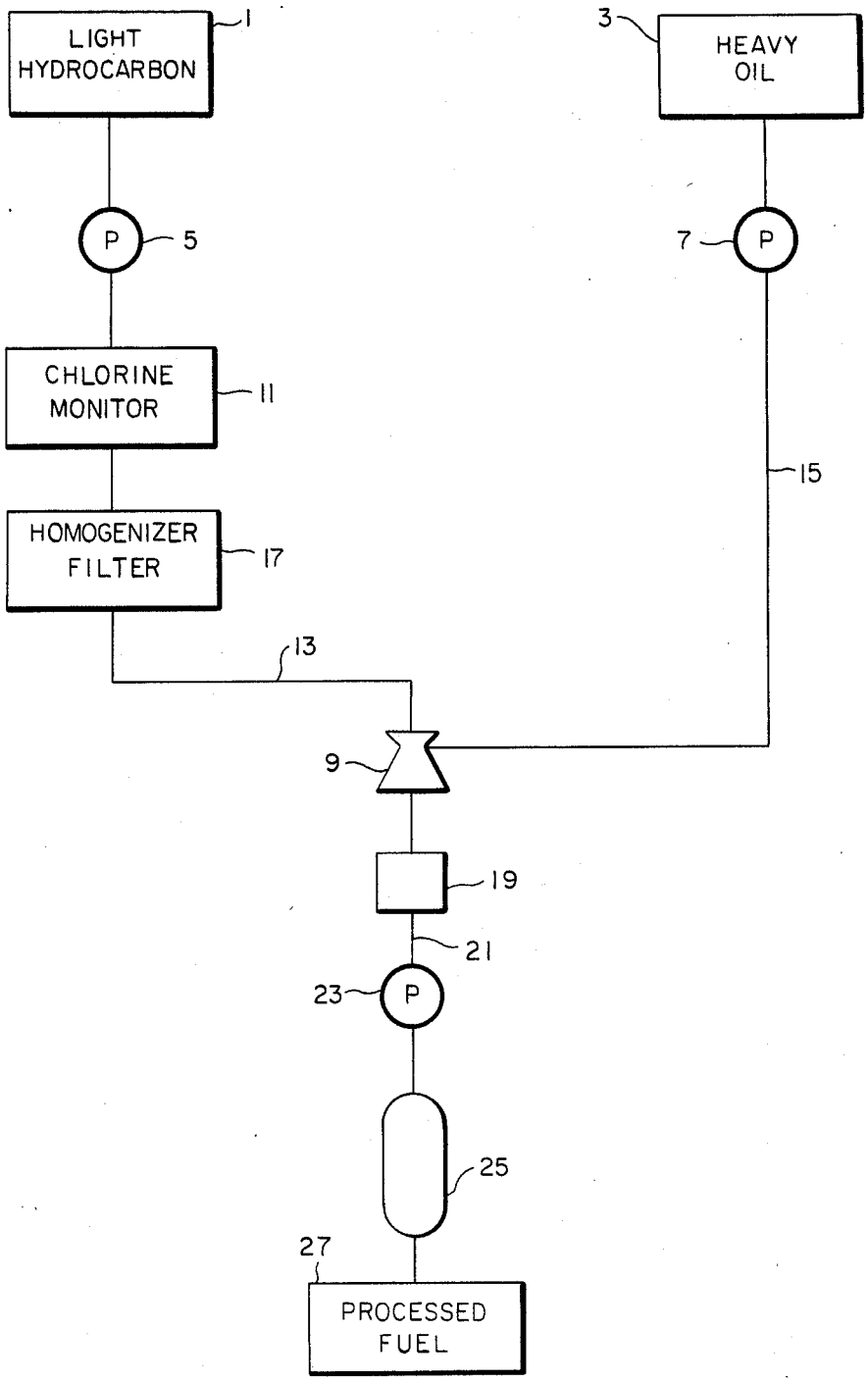
LIGHT HYDROCARBON
1
HEAVY OIL
3
P
5
P
7
CHLORINE MONITOR
11
15
HOMOGENIZER FILTER
17
13
9
19
21
23
P
25
27
PROCESSED FUEL

METHOD AND APPARATUS FOR CATALYTIC PROCESSING OF LIGHT HYDROCARBONS AND CATALYSTS FOR USE THEREIN

This is a continuation of application Ser. No. 797,908, filed Nov. 14, 1985, now abandoned.

BACKGROUND OF THE INVENTION

This invention relates to disposal of light hydrocarbons, e.g., waste organic solvents. More particularly, this invention relates to processing light hydrocarbons with a heavy oil to produce a product which has a higher flash point and is useful as a fuel.

Light hydrocarbons used as solvents in industrial processes, such as textile treating, polymer coating, printing, and other processes, generally become contaminated during use. In many instances, it is not practical to repurify the solvents. Instead, the solvents are merely discarded. Due to the hazardous nature of such materials, special handling is necessary. In most instances it is necessary for industrial concerns desiring to dispose of waste solvents to pay scavengers to remove the solvents to secure landfills or approved incinerators.

Waste solvents are generally highly combustible, highly contaminated and have low flash points. Typical waste solvents have an open cup flash point according to ASTM Standard D-1310-72 below normal room temperature, often as low as −10° C. Such materials are unsuitable for direct use as a boiler fuel because their low flash point indicates an excessively high degree of vaporization will occur in the furnace which would inhibit control of the combustion necessary to achieve smooth, safe operation of the boiler. It is generally held that safe, controlled combustion can be achieved only when the flash point of the fuel is no less than about 40° to 45° C. (approximately 110° F.). Consequently, waste solvents cannot be utilized directly as a fuel for most applications.

Attempts have been made to combine light hydrocarbons and heavy oils to produce useful fuels. Simple mixing of solvent and oil will increase the flash point somewhat. A one to one mixture of waste solvent having a flash point of about −10° C. with No. 6 fuel oil has a flash point of about 18° C. (65° F.) when kept well mixed. However, such mixtures ordinarily separate upon standing so that the low flash point of the solvent will again be encountered. Hays, U.S. Pat. No. 1,416,291, discloses treating a mixture of heavy hydrocarbon, wood alcohol and light hydrocarbon in the vapor phase at elevated temperatures with an aluminum-rich burned clay catalyst mixed with zinc and nickel to produce a fuel mixture. Curtis, U.S. Pat. No. 4,318,623, discloses mixing high volatility combustible fuels with heavy oils using a static mixer. Despite claims by Curtis that his product is stable, simple mixtures of ingredients tend to segregate upon standing for an extended period of time. There remains a need for an improved process and apparatus which can be used to dispose of waste solvents and the like.

SUMMARY OF THE INVENTION

Accordingly, it is the object of the present invention to provide a process and apparatus for treating waste solvent to produce a useful fuel.

Another object of the present invention is to provide a process and apparatus for treating waste solvents to produce a mixture which has a higher flash point and which remains stable even after standing for an extended time.

It is also an object of the present invention to provide a process and apparatus for treating light hydrocarbons to effect molecular rearrangements.

A further object of the present invention is to provide a process and apparatus for treating light hydrocarbon waste to produce a material which is safe, readily handled at ordinary temperatures and poses fewer environmental hazards.

A still further object of the present invention is to provide a process and apparatus for disposing of light hydrocarbon waste in an economically advantageous fashion.

These and other objects of the invention are achieved by providing a process for converting light hydrocarbon to a fuel having a substantially increased flash point comprising the steps of mixing controlled proportions of light hydrocarbon and heavy oil, forcing the resulting mixture under pressure through a porous substrate having a catalytically effective amount of an active oxide of a hexavalent group 6b metal thereon, and collecting the resulting fuel.

In another aspect of the invention, the objects are achieved by providing apparatus for converting light hydrocarbon to a fuel having a substantially increased flash point comprising a porous substrate having a catalytically effective amount of an active oxide of a hexavalent group 6b metal thereon, means for mixing controlled proportions of light hydrocarbon and heavy oil, means for forcing the light hydrocarbon and heavy oil mixture under pressure through said porous substrate in contact with the catalyst thereon, and means for collecting the resulting fuel.

In yet another aspect, the invention comprises a process for preparing a catalyst useful in converting light hydrocarbons to a fuel having a substantially higher flash point, said process comprising wetting a porous substrate with a solution of a salt of a group 6b metal, and thereafter heating the wetted substrate to form a catalytically active oxide of a hexavalent group 6b metal on said substrate.

In particularly preferred aspects of the present invention, the porous substrate is a sintered stainless steel powder material and the catalyst is an active oxide of hexavalent chromium.

BRIEF DESCRIPTION OF THE DRAWINGS

The invention will be explained in further detail with reference to the accompanying drawing which is a schematic representation of apparatus according to the present invention.

DETAILED DESCRIPTION OF PREFERRED EMBODIMENTS

By "light hydrocarbon" is meant a liquid hydrocarbon or a mixture of liquid hydrocarbons having an API gravity of at least 60°, a viscosity of not more than 200 SU at 100° F., and a flash point below 140° F. Generally waste industrial solvent mixtures are suitable for use as the light hydrocarbon in the invention. Examples of suitable solvent ingredients include paraffins such as n-pentane, isopentane, n-hexane, cyclohexane, methylcyclohexane, heptane, octane, isooctane, nonane, n-decane, undecane, dodecane, etc.; alcohols such as methanol, ethanol, n-Propanol, isopropanol, n-butanol, isobutanol, secbutanol, allyl alcohol, amyl alcohol, hexanol, etc.; esters such as ethyl acetate, butyl acetate, amyl acetate, ethylene glycol monoethyl ether acetate, methyl formate, ethyl formate, propyl formate, etc.; aromatics such as benzene, toluene, xylene, ethylbenzene, petroleum naphtha, etc.; ethers such as polyethylene glycol butyl ether, dibutyl ether, ethyl ether, ethylene glycol monoethyl ether, petroleum ether, etc.; glycols such as ethylene glycol, butylene diol, 1,6-hexane diol, glycerol, etc.; ketones such as acetone, methyl ethyl ketone, methyl isobutyl ketone, cyclohexanone, etc.; mineral spirits, turpentine, off-spec. gasoline, coal tar naphtha and similar substances. In most instances light hydrocarbons will be obtained in the form of mixtures of two or more individual substances.

Most preferably, the light hydrocarbon will have a SU viscosity at 100° F. of less than 60 seconds, a total halogen content of less than about 3 percent and a chlorine content of less than about 2 percent, and an ash content of less than about 4 percent. Desirably the solvent mixture should contain less than 15,000 ppm arsenic, barium or titanium, less than 6000 ppm selenium, less than 4000 ppm lead, less than 1,500 ppm cadmium, chromium or mercury, and less than 300 ppm silver.

As used herein, the term "heavy oil" refers to a liquid hydrocarbon or a liquid mixture of hydrocarbons having an API gravity of not more than 45°, a viscosity of at least 140 FU at 122° F., and a flash point of at least 140° F. Suitable heavy oils include any fuel oil having the characteristics of a No. 5 or No. 6 oil. Examples of suitable oils include petroleum distillation bottoms, bunker C oil, gas oil, cycle oil, heavy cutting oils, heavy machine oil, shale oil, crude petroleum, and heavy distillates. For economic reasons, the use of heavier residual oils such as No. 5 or No. 6 fuel oil is particularly preferred.

Desirably the heavy oil will have a sulfur content of less than about 2.2 weight percent. Although oils having sulfur contents approaching this value are classified as high-sulfur fuels, and by themselves are subject to use restrictions in areas where there is a high danger of pollution of the atmosphere with sulfur oxides, when appropriately diluted with light hydrocarbon waste solvents, the effective sulfur content may be reduced to less than 0.5 weight percent so that the product fuel can qualify as a low-sulfur fuel. For environmental reasons, it is also preferred that the heavy oil have a low heavy metal content (less than 1,500 ppm) and a low halogen (e.g. chlorine) content.

The proportions in which the light hydrocarbon and heavy oil may be mixed will vary greatly depending upon the respective identities of the light hydrocarbon and the heavy oil and on the flash point and other properties desired in the product fuel. Generally, the volume ratio of light hydrocarbon to heavy oil may range from about 10:1 to about 1:4; most preferably from about 6:1 to about 1:1.

The catalyst material used in the invention comprises a catalycially active oxide of a hexavalent metal from group 6b of the periodic table. Preferably, the catalyst is an active oxide of hexavalent chromium.

The catalyst is prepared by wetting the surface of a porous substrate with a solution of a soluble salt of a group 6b metal, for example a 10 to 30 weight percent aqueous solution of chromium nitrate, and subsequently heating the wetted substrate in a furnace in the presence of air until the desired active catalyst is formed. To assure complete wetting of the substrate, it is advantageous to immerse the substrate in the solution of group 6b metal salt and then subject the substrate and solution to a subatmospheric pressure until air is completely removed from the pores of the substrate. In general, a vacuum of about 20 to about 30 inches of mercury (about 0.66 to about 1 atmosphere) and a treatment time ranging from less than 5 minutes up to about 30 minutes is sufficient to assure complete removal of all air from the substrate pores, depending on the pore diameter and on the thickness of the substrate. Subsequent reapplication of normal pressure forces the salt solution into the pores of the substrate and assures complete wetting of the substrate.

If desired, prior to wetting the substrate surface with the group 6b metal salt solution, the substrate may be cleaned with a dilute acid solution, e.g., a dilute sulfuric acid solution, to remove any contaminants which might interfere with complete wetting of the substrate surface. Subsequent heating in a furnace in the presence of air to produce the active hexavalent metal oxide may be effected at temperatures ranging from about 400° to about 550° C. for a period of time from about ½ to about 5 hours. It is particularly preferred to effect the heating at a temperature in the range from about 475° to about 535° C. for a period from about 1 to about 3 hours.

When chromium is used as the catalytic metal, the formation of the desired catalyst is visually apparent from the appearance of a coppery coloration on the surface of the substrate material. Excessive heating results in the formation of a black material on the surface which is not catalytically active and is believed to be a form of chromic oxide ($Cr_2O_3$).

As soon as the catalyst has cooled sufficiently following heat treatment that it can be removed from the furnace, it is desirably immersed in oil to protect it from further contact with air. This shields the catalyst against deactivation which has been found to occur upon prolonged exposure to atmospheric oxygen.

Various porous substrates may be utilized for the catalyst material so long as the substrate has an appropriate porosity and sufficient mechanical strength to withstand the applied pressures. The pores of the substrate must be sufficiently large to avoid fouling as the mixture of light hydrocarbon and heavy oil is pumped therethrough and at the same time must be sufficiently small to generate the back pressure and mechanical shear necessary to achieve molecular rearrangement of the light hydrocarbon and heavy oil molecules. The average pore size desirably will lie in the range from about 20 to about 2000 microns, preferably between about 40 and about 500 microns, and most preferably between about 50 and about 200 microns.

A preferred substrate material is made of sintered powder metal particles which are carefully graded to achieve uniform size distribution and then sintered to each other, with or without compression, to form a porous material. Substrate materials made of sintered stainless steel powder are particularly preferred. Such materials are used as filter media and are commercially available from a number of sources, for example, Mott Metallurgical Corporation of Farmington, Conn.

Turning now to the drawing which is a schematic representation of apparatus according to the present invention, it can be seen that the apparatus comprises a light hydrocarbon source in the form of a storage tank 1 and heavy oil source in the form of a storage tank 3. Light hydrocarbon and heavy oil are withdrawn from their storage tanks by volumetric pumps 5 and 7, respectively, and conveyed via lines 13 and 15 to a mixing device, which in the illustrated embodiment is shown as a venturi mixer 9. Conventional flowmeters, not shown, are used to continuously monitor the flow of light hydrocarbon and heavy oil to the mixer and the speed of each volumetric pump is adjusted in response to the detected flow rates in order to form a mixture containing the desired proportions of light hydrocarbon and heavy oil.

If the ultimate fuel contains appreciable amounts of chlorine, then the combustion gases produced when the fuel is burned will contain appreciable hydrogen chloride gas. This is very undesirable from an environmental standpoint, and emmissions of hydrogen chloride gas are strictly regulated by environmental authorities. It is, therefore, highly desirable to use nonchlorinated waste solvents as the light hydrocarbon material in the present invention. To assure that the chlorine content of the light hydrocarbon does not exceed a desired maximum value, for example 2 percent by weight, a chlorine monitor 11 may be disposed on the supply line 13 for the light hydrocarbon. The monitor may be connected to an alarm or to devices for automatically shutting down the apparatus. Since such monitoring and control systems are well known in the art, they will not be described here in further detail.

Also, since waste solvents often are contaminated with particulate materials which might foul the pores of the catalyst substrate, suitable homogenization and filtration devices 17 may be interposed in line 13 to break up and/or remove particulate material above a desired size range.

Waste solvent from line 13 is introduced axially into the center of venturi mixer 9 and intimately admixed with heavy oil from line 15 introduced through one or more radial openings in the throat of the venturi mixer. If desired, further mixing may be accomplished by inserting a static mixer 19, for example a Ross LPD motionless mixer, in line 21.

A pump 23 raises the pressure of the mixture of light hydrocarbon and heavy oil and forces it through a catalytic processor 25 in which the mixture is constrained to pass through a porous substrate having a catalytically active oxide of a hexavalent group 6b metal deposited thereon as described above. In the catalytic processor, molecular rearrangements take place which result in disappearance of the light hydrocarbon as well as of the heavier molecules of the heavy oil. The occurrence of rearrangements is substantiated by comparing gas chromatographic spectra of the product fuel with spectra of the starting materials. The exact mechanism by which such rearrangements occur is not clearly understood, but it is known that both sufficient pressure to generate high mechanical shear forces as the mixture is forced through the pores of the catalyst substrate and the presence of the catalyst material itself on the substrate are necessary to achieve the desired result.

The pressure at which the light hydrocarbon/heavy oil mixture is forced through the porous substrate in contact with the catalyst desirably is at least 500 psi. Maximum pressures are limited only by pump capacity and by the physical strength of the porous substrate. It is preferred to work at pressures ranging from about 600 to about 800 psi.

Processing may advantageously be carried out at temperatures lying in the range from about 0° to about 50° C. At temperatures below 20° C., it may be necessary to preheat the heavy oil to facilitate handling because heavy oils generally have very high viscosities below that temperature. Usual operating temperatures will range from about 20° to about 30° C.

Following passage of the mixture through the catalytic processor, the resulting fuel is collected in a fuel storage tank 27.

Further aspects of the invention will become apparent from a consideration of the following examples, which are intended to be illustrated only, and are not to be considered limiting.

EXAMPLE 1

A 25 mm diameter, approximately 2.4 mm thick porous disk formed by sintering type 316 stainless steel powder and having a nominal pore size of 100 microns is washed with a dilute sulfuric acid solution to remove contaminants. The disk is then immersed in a 20 percent aqueous solution of chromium nitrate [$Cr(NO_3)_3$], and the solution with the porous disk therein is subjected to a vacuum of 0.66 atmosphere for a period of 30 minutes to remove all air from the pores of the disk. Pressure is then reapplied to the solution to force the liquid into all of the pores of the disk. The wet disk is then placed in a furnace maintained at about 510° C. for a period of 1 and ½ hours until a coppery surface coloration appears on the disk. The heat treated disk is then partially cooled and immersed in oil to protect the catalyst from further contact with air.

EXAMPLE 2

A series of cylindrical stainless steel blocks were each provided with six 1,400 micron diameter holes drilled at an angle from end to end therethrough and then sandblasted to form a slightly roughened surface thereon. The blocks were then immersed in chromium nitrate solution and subsequently heat treated at approximately 500° C. for 2 hours to form a catalyst coating thereon.

EXAMPLE 3

Three parts of light hydrocarbon and one part No. 6 fuel oil were intimately mixed and then forced at a pressure of 600 pounds per square inch and a temperature of approximately 49° C. through the catalyst blocks of Example 2. The light hydrocarbon consisted of equal volumetric portions of isopropyl alcohol, methyl ethyl ketone, n-butyl acetate and toluene. Comparison of a gas chromatographic spectrum of the fuel mixture taken prior to passage through the catalytic blocks with a gas chromatographic spectrum of the resulting fuel showed an average 10 percent decrease in the area of the peaks corresponding to the individual ingredients of the light hydrocarbon mixture, thus indicating that some of the light hydrocarbon had been reacted to form higher molecular weight species.

EXAMPLE 4

Three parts of a light hydrocarbon mixture formed by admixing equal volumes of isopropyl alcohol and n-butyl acetate were intimately mixed with one part of No. 6 fuel oil and the resulting mixture was passed at a pressure of 600 psi and a temperature of approximately 49° C. through the catalyst blocks of Example 2. Analysis of gas chromatographic spectra taken of the mixture fed to the catalytic blocks and the resulting fuel showed a 29 percent decrease in the amount of isopropyl alcohol and a 35 percent decrease in the amount of n-butyl acetate.

EXAMPLE 5

The procedure of Example 3 was repeated except that the pressure was only 300 psi. Comparison of the initial and final spectra showed no change in the proportions of light hydrocarbon. This example indicates that a pressure high enough to produce sufficient back pressure and mechanical shear as the mixture of light hydrocarbon and heavy oil is forced through the pores of the substrate in contact with the catalyst is essential to achieve the desired conversion.

EXAMPLE 6

The flash point of a mixture of three parts light hydrocarbon composed of equal volumes of isopropyl alcohol, methyl ethyl ketone, n-butyl acetate and toluene with one part of No. 6 fuel oil was tested according to ASTM standard D-1310-72 and found to be less than 15° C. The mixture of light hydrocarbon and heavy oil was then forced through the blocks of Example 2 at a pressure of 600 psi and at an ambient temperature of approximately 25° C. The flash point of the resulting fuel was then tested according to ASTM standard D-1310-72 and found to be 46.6° C.

EXAMPLE 7

Three parts of waste solvent comprising over 95 percent mixed xylenes and the balance other organic liquids was forced at a pressure of 600 psi and at ambient temperature through a series of three catalyst disks prepared according to Example 1. The flash point of the material was tested according to ASTM standard D-1310-72 and found to have been increased from 19.4° C. to over 40° C.

EXAMPLE 8

A mixture of four parts light hydrocarbon comprising over 95 percent mixed xylenes and the balance other organic liquids with one part of No. 6 fuel oil was passed at a pressure of 700 psi and at ambient temperature through a series of three disks prepared according to Example 1. The flash points of the initial mixture and final fuel were determined according to ASTM standard D-1310-72 and found to be 19.4° C. and 57° C., respectively.

EXAMPLE 9

Six parts of a mixture comprising equal volumes of isopropyl alcohol, methyl ethyl ketone, n-butyl acetate and toluene were combined with one part of used crankcase oil and passed through a series of three disks prepared according to Example 1 at a pressure of 700 psi and at ambient temperature. The flash point of the resulting fuel was found to have been increased to 32.7° C.

EXAMPLE 10

Ten parts of the product of Example 9 were admixed with one part No. 6 fuel oil and forced at a pressure of 700 psi and at ambient temperature through a series of three catalyst disks prepared according to Example 1. The flash point of the resulting product was found to be 50.5° C.

EXAMPLE 11

A mixture of three parts light hydrocarbon composed of equal volumes of isopropyl alcohol, methyl ethyl ketone, n-butyl acetate and toluene with one part of No. 6 fuel oil were passed at a pressure of 700 psi through a series of three disks of sintered stainless steel powder having a nominal pore size of 100 microns without any treatment of the porous disk to form a catalytically active oxide of group 6b metal thereon. A comparison of chromatographic spectra of the mixture taken before and after passage through the porous substrate showed no discernable change in composition. This example shows the importance of the presence of the catalytically active oxide of a hexavalent group 6b metal on the porous substrate.

The fuel product produced according to the present invention does not separate upon standing, even for extended periods. The invention also results in mixtures having substantially higher flash points than simple mixtures of the feed materials. The increase in flash points depends on the solvent/oil ratio. At a 10:1 solvent to oil ratio, the typical flash point will increase between 12° and 15° C. and at a 4:1 solvent to oil ratio the typical increase in flash point is about 30° to 45° C. By controlling the proportion of solvent to oil, it is possible to produce a fuel having a desired flash point, e.g., at least 45° C.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with respect to the appended claims and equivalents.

I claim:

1. A process for converting light hydrocarbon to a stable liquid fuel having a higher flash point than said light hydrocarbon comprising the steps of:

(a) mixing controlled proportions of light hydrocarbon having an API gravity of at least 60°, a viscosity of not more than 200 SU at 100° F., and a flash point below 140° F. and heavy oil having an API gravity of not more than 45°, a viscosity of at least 140 FU at 122° F., and a flash point of at least 140° F.;

(b) forcing the resulting mixture consisting essentially of said light hydrocarbon and said heavy oil under a pressure of at least about 500 psi through a porous substrate having an amount of a catalytically active oxide of hexavalent group 6b metal thereon effective to catalytically effect molecular rearrangements in at least one constituent of said mixture and produce a stable fuel which does not separate upon standing, and (c) collecting the resulting fuel.

2. A process according to claim 1, wherein said porous substrate is a porous material formed of sintered metal powder.

3. A process according to claim 2, wherein said metal powder is stainless steel powder.

4. A process according to claim 1, wherein said porous substrate has an average pore size lying in the range from about 40 to about 500 microns.

5. A process according to claim 1, wherein said group 6b metal is chromium.

6. A process according to claim 1, wherein said light hydrocarbon is a mixture of at least two substances selected from paraffins, monoalcohols, esters, aromatic compounds, ethers, glycols, ketones, turpentine, naphtha, and a gasoline.

7. A process according to claim 1, wherein said heavy oil is selected from the group consisting of residual oils, bunker C oil, heavy cutting oil, shale oil and crude petroleum.

8. A process according to claim 1, wherein the ratio of light hydrocarbon to heavy oil lies in the range from about 10:1 to about 1:4.

9. A fuel produced by the process of claim 1.

* * * * *